US010888725B2

(12) United States Patent
Schnell et al.

(10) Patent No.: US 10,888,725 B2
(45) Date of Patent: Jan. 12, 2021

(54) SPRINKLER FOR FIRE EXTINGUISHER SYSTEMS

(71) Applicant: Minimax GmbH & Co. KG, Bad Oldesloe (DE)

(72) Inventors: Stefan Schnell, Stockelsdorf (DE); Frank Roennfeldt, Travenbrueck (DE)

(73) Assignee: Minimax GmbH & Co. KG, Bad Oldesloe (DE)

( * ) Notice: Subject to any disclaimer, the term of this patent is extended or adjusted under 35 U.S.C. 154(b) by 0 days.

(21) Appl. No.: 15/765,910

(22) PCT Filed: Oct. 4, 2016

(86) PCT No.: PCT/EP2016/073680
§ 371 (c)(1),
(2) Date: Apr. 4, 2018

(87) PCT Pub. No.: WO2017/060244
PCT Pub. Date: Apr. 13, 2017

(65) Prior Publication Data

US 2018/0304109 A1 Oct. 25, 2018

(30) Foreign Application Priority Data

Oct. 5, 2015 (DE) ..... 10 2015 219 208

(51) Int. Cl.
*A62C 35/68* (2006.01)
*A62C 37/14* (2006.01)
*A62C 31/02* (2006.01)

(52) U.S. Cl.
CPC ..... *A62C 35/68* (2013.01); *A62C 37/14* (2013.01); *A62C 31/02* (2013.01)

(58) Field of Classification Search
CPC ..... A62C 35/68; A62C 37/14; A62C 31/02
(Continued)

(56) References Cited

U.S. PATENT DOCUMENTS 4,007,878 A * 2/1977 Anderson ..... A62C 37/10 239/209
4,217,961 A * 8/1980 Wotton ..... A62C 37/10 169/41

(Continued)

FOREIGN PATENT DOCUMENTS

CN 2322653 Y 6/1999
CN 201370915 Y 12/2009

(Continued)

OTHER PUBLICATIONS

International Search Report and Written Opinion (in German and English), International Application No. PCT/EP2016/073680 (published under WO 2017/060244), 19 pages (dated Dec. 7, 2016).

(Continued)

*Primary Examiner* — Chee-Chong Lee
(74) *Attorney, Agent, or Firm* — Perkins Coie LLP

(57) ABSTRACT

A sprinkler (1), includes a sprinkler housing, a fluid channel which is provided in the sprinkler housing and has a fluid inlet (10) and at least one fluid outlet (8), a closure element (4), which is movable from a blocking position into a release position, wherein the closure element (4) closes the fluid channel in the blocking position and releases same in the release position, a thermally activatable triggering element (25), which keeps the closure element (4) in the blocking position until thermally activated, and a sealing element (5), which is arranged between the sprinkler housing and the closure element (4) and is designed to close the fluid channel in a fluid-tight manner in the blocking position. A sealing element (5) is radially and axially compressed in the blocking position in order to apply the sealing effect.

18 Claims, 7 Drawing Sheets

(58) Field of Classification Search
USPC ..... 169/37
See application file for complete search history.

(56) References Cited

U.S. PATENT DOCUMENTS

| | | | | |
|---|---|---|---|---|
| 4,619,327 | A * | 10/1986 | Pieczykolan | A62C 37/14 169/38 |
| 5,622,225 | A | 4/1997 | Sundholm | |
| 6,296,062 | B1 | 10/2001 | Sundholm | |
| 6,962,208 | B2 * | 11/2005 | Franson | A62C 37/09 169/16 |
| 7,510,128 | B2 * | 3/2009 | Schouten | B05B 12/0022 239/541 |
| 2006/0237199 | A1 | 10/2006 | Sundholm | |
| 2014/0367125 | A1 | 12/2014 | Krager et al. | |
| 2014/0374126 | A1 | 12/2014 | Helasuo et al. | |

FOREIGN PATENT DOCUMENTS

| | | | |
|---|---|---|---|
| DE | 198 12 994 | A1 | 9/1999 |
| DE | 20002324 | U1 | 5/2000 |
| DE | 29922674 | U1 | 8/2000 |
| DE | 10 2008 060233 | A1 | 6/2009 |
| EP | 0 797 465 | A1 | 10/1997 |
| EP | 0 797 466 | A1 | 10/1997 |
| EP | 1 404 418 | A1 | 4/2004 |
| EP | 1 944 066 | A2 | 7/2008 |
| JP | 2008-264036 | A | 11/2008 |

OTHER PUBLICATIONS

Office Action (with English translation), Japanese Application No. 2018-536341, 5 pages (dated Jul. 21, 2020).
Second Office Action (with English translation), Chinese Application No. 201680058382.0, 23 pages (dated Aug. 21, 2020).

* cited by examiner

SPRINKLER FOR FIRE EXTINGUISHER SYSTEMS

CROSS-REFERENCE TO RELATED APPLICATIONS

This application is a National Stage of International Application No. PCT/EP2016/073680, filed Oct. 4, 2016 (now WO 2017/060244 A1), which claims priority to German Application No. 102015219208.3, filed Oct. 5, 2015. The entire disclosures of each of the above applications are incorporated herein by reference.

FIELD

The present disclosure relates to a sprinkler for fire extinguisher systems.

BACKGROUND AND SUMMARY

The aforementioned sprinklers are generally known and are used either as high-pressure sprinklers or as low-pressure sprinklers. A common feature of said types of sprinklers is that, after their initial installation, they frequently remain unactuated for very long periods of time. In the best case scenario, such sprinklers are unused for their entire operating life because fires do not happen. In the case of known types of sprinklers, it has turned out that the seals used in the sprinklers have a tendency, in extreme cases, over the course of time to stick to the sealing surface and thus to impede or even to prevent opening of the closure elements if the sprinkler actually has to be used in the event of a fire. Furthermore, it has turned out that, in situations in which, although opening is impeded but is not prevented, the known seals in extreme cases partially or entirely fall apart. Individual parts of the sealing elements then move freely in the interior of the sprinklers and may potentially obstruct the fluid outlets.

In the case of sealing elements which are compressed exclusively in the axial direction in the sprinkler in order to achieve the sealing effect, it has been observed in particular that, because of the high pre-compaction which is required for producing the sealing effect, a loss of sealing force of the sealing element occurs over longer lifetimes. It has furthermore been observed as a disadvantage that the required high pre-compaction subjects the thermal triggering element installed in the sprinkler to a loading in addition to the compressive loading by the system pressure. Although, in the normal situation, the thermally activatable triggering elements have sufficient safety factors in order to withstand said pressures, the additional loading as a result of the necessary pre-compaction is perceived to be disadvantageous.

When sealing elements from the prior art are exclusively compressed radially, the resulting adhesive bonds and/or incrustations necessitate a high stand-by pressure, as a rule of 20 bar or more, in order to open the closure element. This is associated with high energy costs and an increased leakage rate of the pipe/sprinkler connecting elements.

In view of these problems, it has therefore been previously resorted to in the prior art for the sealing elements to be provided with special adhesion-reducing coatings. However, this leads to significantly increased cost expenditure.

Furthermore, it has therefore been resorted to on a trial basis in the prior art to provide very high surface quality in order to minimize the adhesion to the sealing surfaces, which is likewise associated with a significantly increased outlay on costs.

Accordingly, the disclosure was based on the object of specifying a sprinkler, in which the abovementioned disadvantages are mitigated as substantially as possible. In particular, the disclosure was based on the object of specifying a sprinkler, in which the error-free operation is not impaired despite a long lifetime.

The disclosure achieves the object on which it is based with a sprinkler of the present disclosure. Advantageous refinements and developments are found in the explanations below of the description and of the figures.

According to the disclosure, a sprinkler is proposed, comprising a sprinkler housing, a fluid channel which is provided in the sprinkler housing and has a fluid inlet and at least one fluid outlet, a closure element, which is movable from a blocking position into a release position, wherein the closure element closes the fluid channel in the blocking position and releases same in the release position, a thermally activatable triggering element, which keeps the closure element in the blocking position until thermally activated, and a sealing element, which is arranged between the sprinkler housing and the closure element and is designed to close the fluid channel in a fluid-tight manner in the blocking position, wherein the sealing element is radially and axially compressed in the blocking position in order to apply the sealing effect. Closing the fluid channel is understood in this context as meaning that a fluid-conducting connection from the fluid inlet as far as the fluid outlet is interrupted in the blocking position while it exists in the release position. In the case of the sprinkler according to the disclosure, the thermal triggering element is preferably provided in such a manner that it is destroyed by thermal action or changes its structure. The thermally activatable triggering element is particularly preferably a sprinkler ampule, in particular a fluid-filled glass ampule. Alternatively, the thermally activatable triggering element is designed as a fusible link or a metal element having memory properties, for example as a bimetal element.

The disclosure is based on the finding that, in the case of known seals, because of the sometimes very high contact pressures (in particular during operation of the sprinklers as high-pressure sprinklers), changes occur to the material properties of the sealing elements over the course of time, said changes firstly leading to settling processes of the sealing elements on the surface structure of the adjoining sealing surfaces, and secondly leading to incrustations or embrittlement of the material.

If the sprinkler is then actuated, the adhesive bonds, incrustations and the like provide increased resistance to the opening movement of the closure element. In addition, it has been recognized that, in the case of sprinklers which use known sealing elements, the sealing elements are always compressed either exclusively radially or exclusively axially in order to produce the sealing effect. Particularly in the case of radially compressed sealing elements, the sealing element has to be displaced along the sealing surface for a comparatively long distance in the release direction in order to release the fluid channel. This causes the sealing element to be exposed to a high shearing load, which firstly results in an increased movement resistance and secondly in the risk of partial or complete destruction of the sealing element, with the disadvantageous effect of releasing particles in the interior of the sprinkler.

The disclosure starts precisely here by providing an arrangement of the sealing element, in which the sealing element is compressed both radially and axially. By means of the combination of a radial and axial sealing effect, two or more partial sealing surfaces are provided on the sealing element and, taken in isolation, are in each case smaller than an individual sealing surface in sealing elements from the prior art. This already significantly minimizes the production of adhesions and incrustations, for example as a result of settling processes.

The sprinklers according to the disclosure designed in such a manner exhibit an already significantly reduced error susceptibility in respect of their opening behavior, because of the lower tendency of the sealing elements to adhesively bond, and a significantly lower risk of destruction of the sealing elements, which is associated with increased operating reliability of the sprinklers.

The thermally activatable triggering element is preferably designed in order, when a predefined temperature is exceeded, to relinquish the resistance against movement of the closure element out of the blocking position, whereupon the closure element can make its way from the blocking position into the release position and the extinguishing fluid can flow through the fluid channel and out of the fluid outlets. During operation, the sprinkler is fastened, preferably on the fluid inlet sides, either directly or indirectly via an adapter, to a pipe conducting extinguishing fluid.

The disclosure is advantageously developed by the sealing element being pressed in the blocking position against a sealing surface which expands in a release direction A. The release direction A is understood here as meaning the direction of movement of the closure element from the blocking position into the release position. The sealing surface which expands in the release direction is understood as meaning that the surface normal of the sealing surface has an angle different from 90° with respect to the release direction A.

The expanding sealing surface is preferably of at least partially conical design, and/or is curved convexly, and/or is curved concavely. A convex curvature is understood here as meaning an expansion which is progressive in the release direction, while a concave curvature is understood as meaning an expansion which is digressive in the release direction A. The common advantage of the different configurations of the expanding sealing surface is that the sealing element no longer touches the expanding sealing surface even after an extremely short travel out of the blocking position. By contrast to sealing elements which are known from the prior art and are exclusively loaded radially, the sealing element therefore no longer has to be pushed along the sealing surface over extended distances in the axial direction (i.e. in the release direction A). This firstly results in a significantly reduced triggering resistance and secondly in a significantly reduced risk of destruction of the sealing element during opening. Both contribute directly to the increased operating reliability of the sprinkler as a whole.

In a preferred embodiment, the first sealing element is formed from a list consisting of: an O ring, an O ring with a supporting ring, quad ring, multi-lip sealing ring, in particular X ring or V ring, grooved ring, a sealing element which is vulcanized on, or in the form of a combination of a plurality of said sealing elements.

The expanding sealing surface is preferably formed on the sprinkler housing. Furthermore preferably, the closure element has an axially extending sealing surface against which the sealing element is pressed in the blocking position.

Furthermore preferably, the closure element has a radially extending sealing surface against which the sealing element is pressed in the blocking position.

The axial and/or radial sealing surfaces here are mating surfaces to the expanding sealing surface, wherein the primary sealing effect is produced on the expanding sealing surface, wherein one or both further sealing surfaces primarily act as counter-bearings and secondarily as sealing surfaces. They also make an important contribution to minimizing the size of the primary sealing surface.

In that embodiment in which the expanding sealing surface is of at least partially conical design, the conically formed portion preferably has a cone angle $\alpha 1$ which lies within an angular range of 5° to 60°, preferably 10° to 40°, particularly preferably 20° to 30°.

In a further preferred embodiment, the sprinkler housing has a main body and a passage unit. The fluid inlet and/or the expanding sealing surface are preferably formed on the passage unit. The passage unit is preferably connected in a reversibly releasable manner to the main body, for example by means of a screw connection. This permits economically favorable manufacturing of the main body, for example as a cast part, and a likewise economical machining manufacturing of the passage unit.

In addition, in preferred refinements, a diaphragm for the passage of the extinguishing fluid in the direction of the sealing surface or of the closure element in the mounted state is provided on the passage unit.

The main body preferably has a connection unit for fastening the sprinkler to an extinguishing fluid supply, i.e. to the pipe system conducting the extinguishing fluid, in particular with a receiving channel for receiving the fluid entry channel, and a nozzle head and a cage, wherein a distribution chamber from which the at least one fluid outlet extends is formed in the interior of the nozzle head.

The cage preferably defines a cage compartment for receiving the thermal triggering element.

Furthermore preferably, an abutment for receiving and axially positioning the thermal triggering element in the sprinkler relative to the closure element is provided, in particular integrally formed, on the cage.

In a further preferred embodiment of the sprinkler, the closure element has a second sealing surface which is tapered in the release direction A, and the sprinkler housing, in particular the main body, has a third sealing surface which is tapered in the release direction A, wherein the second and third sealing surfaces lie against each other, preferably in a fluid-tight manner, in the release position of the closure element.

In a particularly preferred refinement, the second and third sealing surfaces, which are tapered in the release direction, form an elastomer-free seal.

It is preferred that the second and third tapered sealing surfaces have substantially corresponding surface contours. If the second and third tapered sealing surfaces are, for example, of conical design, it is preferred if the angle of taper of the two tapered sealing surfaces differs only by a few degrees from each other, preferably within a range of less than 5° in terms of amount.

In a second aspect of the disclosure, the sprinkler housing has a recess, through which the closure element extends at least in the release position, wherein a protective chamber in which the sealing element is arranged is defined between the closure element and the recess in the release position. The most effective protection measure for the sealing element consists in removing it as far away as possible from the main flow, which extends from the fluid inlet to the fluid outlet or the fluid outlets in the triggering event, i.e. when the closure element is in the release position. For this purpose, a protective chamber is provided between the recess for receiving the closure element and the sealing element, within which protective chamber the sealing element is arranged. In other words, according to the disclosure, in the release position, the sealing element is located within the recess in order to receive the closure element in a region with reduced flow. The admission into said recess means that the sealing element is exposed to less severe stresses due to the flow of the extinguishing fluid, and the risk of partial or complete destruction of the sealing element is greatly reduced.

In a particularly preferred refinement of the disclosure, the sprinkler housing has a distribution chamber from which both the recess for receiving the closure element and the at least one fluid outlet branch, wherein the recess for receiving the closure element extends in a first direction, preferably identically to the release direction A, and the at least one fluid outlet extends in a second direction which is different from the first direction. Owing to the fact that the recess branches off from the distribution chamber, the sealing element, in the release position of the closure element, is de facto located outside the distribution chamber in a "secondary arm" which is already exposed to a less severe flow on account of the fact that the main flow takes place in the direction of the fluid outlets. In addition, in the recess and around the recess, on account of the differently oriented axes of the fluid outlet and of the recess for receiving the closure element, turbulence is formed around the recess for receiving the closure element, the turbulence further reducing the flow loading on the sealing element.

The at least one fluid outlet preferably lies arranged radially outside and/or, as seen in the release direction A, upstream of the recess for receiving the closure element. In particular because of the "preference" for the fluid outlets counter to the release direction, a dead space in which flow moves primarily turbulently is formed below the fluid outlets during operation.

In a further preferred refinement, the closure element has an encircling groove in which the sealing element sits. The encircling groove provides a depression for receiving the sealing element, said depression receiving the sealing element into the closure element partially or completely radially, as a result of which further shielding of the sealing element from the surrounding fluid flow is provided.

Counter to the release direction A and adjacent to the encircling groove accommodating the sealing element, the closure element preferably has a projection for protecting the sealing element against flow influences in the release position. The projection forms the flank of the groove, in which the sealing element sits, which flank is positioned out of the groove in the direction of the distribution chamber. The provision of such a projection has the effect that the protective chamber which is formed between the recess for receiving the closure element and the closure element itself is at least partially closed on its side positioned counter to the release direction A and preferably facing the distribution chamber. This creates a particularly strong partitioning of the sealing element from the flow conditions prevailing in the distribution chamber. This structural solution is appropriate for particularly high operating pressures, for example in the region above 100 bar.

In a further preferred embodiment, a flow diverter is formed on the projection. The flow diverter is preferably designed to serve as an impact element for the extinguishing fluid entering the distribution chamber and to produce turbulence.

The flow diverter preferably extends into the distribution chamber counter to the release direction A. Furthermore preferably, the flow diverter is designed to divert extinguishing fluid, which flows into the distribution chamber, from the first direction in which the recess is oriented.

Furthermore preferably, the flow diverter is designed to divert extinguishing fluid, which flows into the distribution chamber, toward the second direction in which the fluid outlet or the fluid outlets are oriented.

The projection preferably has a diameter of at least the sum of a basic diameter of the groove, which accommodates the sealing element, and half of the material thickness in the radial direction of the sealing element. This ensures good protection and at the same time a reliable fit of the sealing element in the groove.

The sprinkler housing is advantageously developed by the fact that the at least one fluid outlet is designed as a bore, or alternatively as a reversibly releasably coupled insertion element which, in particularly preferred refinements, has a swirl body.

By means of the design as an insertion element, diverse fluid output patterns, for example spray cones, can be realized.

In a further preferred refinement, the sprinkler housing according to the present disclosure has a cage which defines a cage compartment for receiving the closure element in the release position, and for receiving a thermally activatable triggering element in the blocking position. This refinement in particular permits the use of the sprinkler housing as an open extinguishing nozzle if the use of the thermally activatable triggering element is dispensed with. In this case, in the mounted installation position of the sprinkler housing, the closure element is permanently in the release position, which is not disadvantageous because the sealing element is arranged in the protective chamber.

Alternatively, this refinement permits the use of the sprinkler housing together with a thermally activatable triggering element, which is inserted into the cage compartment, in a sprinkler, in particular at a high-pressure sprinkler. Consequently, the disclosure also achieves the object on which it is based in a sprinkler of the type referred to at the beginning by a sprinkler housing designed according to one of the preferred embodiments described above being used thereon.

Furthermore, the disclosure achieves the object on which it is based, in the case of the second aspect, by the use of a sprinkler housing according to one of the preferred embodiments described above as an extinguishing nozzle, in particular as an extinguishing nozzle for operating pressures in the region above 16 bar.

In a third aspect, the disclosure proposes that the sprinkler housing has a fluid channel with a fluid inlet and at least one fluid outlet, a distribution chamber, from which the at least one fluid outlet branches, and a cage which defines a cage compartment for receiving a thermally activatable triggering element, wherein the distribution chamber and the cage are designed as an integral main body, and an abutment for the axial and preferably radial positioning of the thermally activatable triggering element is integrally formed on the cage. Within the context of the disclosure, the cage together with its cage compartment serves, in a blocking position of the sprinkler housing, to receive the thermally activatable triggering element and, after destruction of the thermally activatable triggering element, a closure element which is provided in the sprinkler housing and is movable from a blocking position into a release position, wherein the closure element closes the fluid channel in the blocking position and releases same in the release position.

According to the third aspect, the disclosure makes use of the fact that, by means of the integral formation of the distribution chamber and of the cage as a main body together with the abutment integrally formed on the cage, firstly a component having high functional integration is created which can be produced in an economically favorable manner and at the same time, due to substantially dispensing with intersections, minimizes the risk of dirt being admitted into the interior of the sprinkler housing. Secondly, this approach achieves the result that the thermally activatable triggering element needs only to be inserted into the cage. The cage already fixedly contains an abutment for the axial and preferably radial positioning of the thermally activatable triggering element, and therefore a separate setting of the axial position and of the holding stress of the thermally activatable triggering element relative to the sprinkler housing is no longer necessary. The closure element is preferably adapted to be kept in the blocking position, when a thermally activatable triggering element is fitted, until the closure element is triggered by means of the thermally activatable triggering element. In other words, the thermally activatable triggering element is held between the closure element and the abutment of the cage, and therefore the stress acting on the thermally activatable triggering element arises exclusively from the dimensioning of the closure element and the fluid pressure present on the inlet side of the fluid channel. Both the fluid pressure and the dimensioning of the closure element can be predefined and adjusted during manufacturing with a high degree of reliability, and therefore the risk of erroneous installation of the thermally activatable triggering element, which would have the consequence of the unintentional failure of said triggering element, can be very substantially eliminated.

In a further preferred refinement, the sprinkler housing therefore has a closure element which is movable in a release direction A from a blocking position into a release position, wherein the closure element closes the fluid channel in the blocking position and releases same in the release position, wherein the sprinkler housing, in particular the main body, has a recess through which the closure element extends in the direction of the cage, at least in the release position, wherein the closure element is adapted in order, when a thermally activatable triggering element is fitted, to be held in the blocking position until said triggering element is triggered.

For this purpose, the closure element preferably likewise has, for the axial positioning, an abutment which faces the thermally activatable triggering element, in the fitted state of the latter.

The recess for receiving the closure element preferably branches off from the distribution chamber, wherein the recess for receiving the closure element preferably extends in the release direction A. The disclosure is advantageously developed and, in a separate aspect, characterized in that the main body is composed of one of the following materials: copper alloy, preferably brass, in particular seawater-resistant brass, or bronze, in particular seawater-resistant bronze; non-alloyed or alloyed steel, in particular stainless steel; cast iron material; high grade steel; aluminum or an aluminum alloy; die-cast zinc; titanium or a titanium alloy; magnesium or a magnesium alloy; sintered metal material; ceramic material; plastic, in particular thermoplastic, thermosetting plastic or liquid crystal polymer, wherein the plastic preferably in each case has a melting point above 190° C., furthermore preferably above 400° C., particularly preferably above 600° C.; or a composite material, in particular glass fiber reinforced plastic or carbon fiber reinforced plastic, preferably having the abovementioned melting points.

The seawater-resistant brass which is used is preferably CuZn20Al2As, CuZn36Pb2As, CuZn21Si3P, CuZn38As, CuZn33Pb1AlSiAs or CuZn33Pb1,5AlAs.

The seawater-resistant bronze which is used is preferably lead bronze, for example CuPb5Sn5Zn5, or aluminum bronze, for example CuAl10Fe3Mn2, CuAl10Ni5Fe4, CuAl10Ni5Fe5, CuAl11Fe6Ni6, CuAl5As, CuAl8, CuAl86Fe3, CuAl7Si2, CuAl9Ni, CuAl10Ni3Fe2, CuAl10Ni, CuAl10Fe5Ni5, CuAl11Ni, CuAl11Fe6Ni6, CuAl10Fe, CuAl10Fe2 or CuAl8Mn.

In a further preferred embodiment, the main body of the sprinkler housing has a metallic coating at least in the region of the at least one fluid outlet and/or of the distribution chamber, and preferably completely.

The metallic coating preferably has a layer thickness within a range of 0.1 to 125 μm.

In a particularly preferred embodiment, the main body is chemically metallized in the above-described region or completely. Chemical nickel plating has turned out to be a particularly preferred variant of the chemical metallization. The chemical nickel coating is preferably applied in accordance with DIN EN ISO 4527. In this case, a nickel-phosphorus alloy coating is applied over the basic material by means of autocatalytic deposition, wherein the surface of the main body can be prepared either mechanically or by means of acid treatment (for example chloric acid treatment) in order to achieve better adhesion of the coating.

It has proven surprising that the combination of one of the aforementioned materials as the basic material with the chemical metallization and particularly preferably with the chemical nickel plating results in a significant improvement in clogging resistance. Within the scope of the approval test, it is of essential importance in the case of sprinklers and extinguishing nozzles that the flow rate does not change or changes only very slightly over the course of the service life. The risk of obstruction by corrosion products is already substantially reduced by the selection of a sufficiently corrosion-resistant basic material. A further problem, however, is that, when water is used which is not of pure quality, but rather is soiled with particles and the like, abrasion or erosion of the fluid outlets may occur at very high pressures, as a result of which the cross section of said fluid outlets expands. However, an increase in the fluid outlet cross section may also lead to failure during a clogging test. As an example of a clogging test, reference is made here to the guidelines MSC/Circ.1165 of Jun. 10, 2005, published by the IMO (International Maritime Organisation, 4 Albert Embankment, London SE7SR).

With the above-proposed combination of basic material and chemical metallization, a basic body is obtained which can be successfully subjected to a clogging test without being damaged due to the abrasive test medium.

The sprinkler housing according to this aspect and the sprinkler housing according to the aspect of integrity mentioned further above preferably have the same preferred embodiments and are preferred embodiments of one another.

In a further preferred embodiment, the main body is heat-treated at least in the region of the at least one fluid outlet and/or of the distribution chamber. With the aid of a heat treatment, the surface hardnesses obtained by the chemical metallization can be increased even further. This is used particularly advantageously in the case of those basic materials which are non-curable per se, for example copper alloys.

During the heat treatment, the main body is preferably heat-treated at a temperature below the melting point of the material of the main body, preferably within a range of 190°

C. up to 600° C., depending on the material of the main body, and with a holding time of half an hour or more, particularly preferably within a range of from 1 to 20 hours.

This is understood to the effect that basic materials which have a low melting point per se, for example polymer materials, are treated at a correspondingly lower temperature, but with a greater holding time.

The disclosure achieves the object on which it is based in the case of a sprinkler of the type referred to at the beginning, in particular in the case of a high-pressure sprinkler (having an operating pressure above 16 bar), with a sprinkler housing according to one of the preferred embodiments described above, and a thermally activatable triggering element which is accommodated in the cage and keeps the closure element in the locking position until said triggering element is activated.

With regard to the advantages achieved and preferred embodiments, reference is made to the explanations above.

Furthermore, the disclosure achieves the object on which it is based, according to the third aspect, by specifying a use of the sprinkler housing as an extinguishing nozzle, in particular a sprinkler nozzle according to a preferred embodiment described above, wherein the extinguishing nozzle is configured in particular for operating pressures in the region above 16 bar.

The preferred embodiments according to the first aspect are at the same time preferred embodiments according to the second and third aspect. The preferred embodiments according to the second aspect are at the same time preferred embodiments according to the first and third aspect. The preferred embodiments according to the third aspect are at the same time preferred embodiments according to the first and second aspect.

DRAWINGS

The disclosure is described in more detail below using a preferred exemplary embodiment and with reference to the attached figures, in which.

Figure 4:
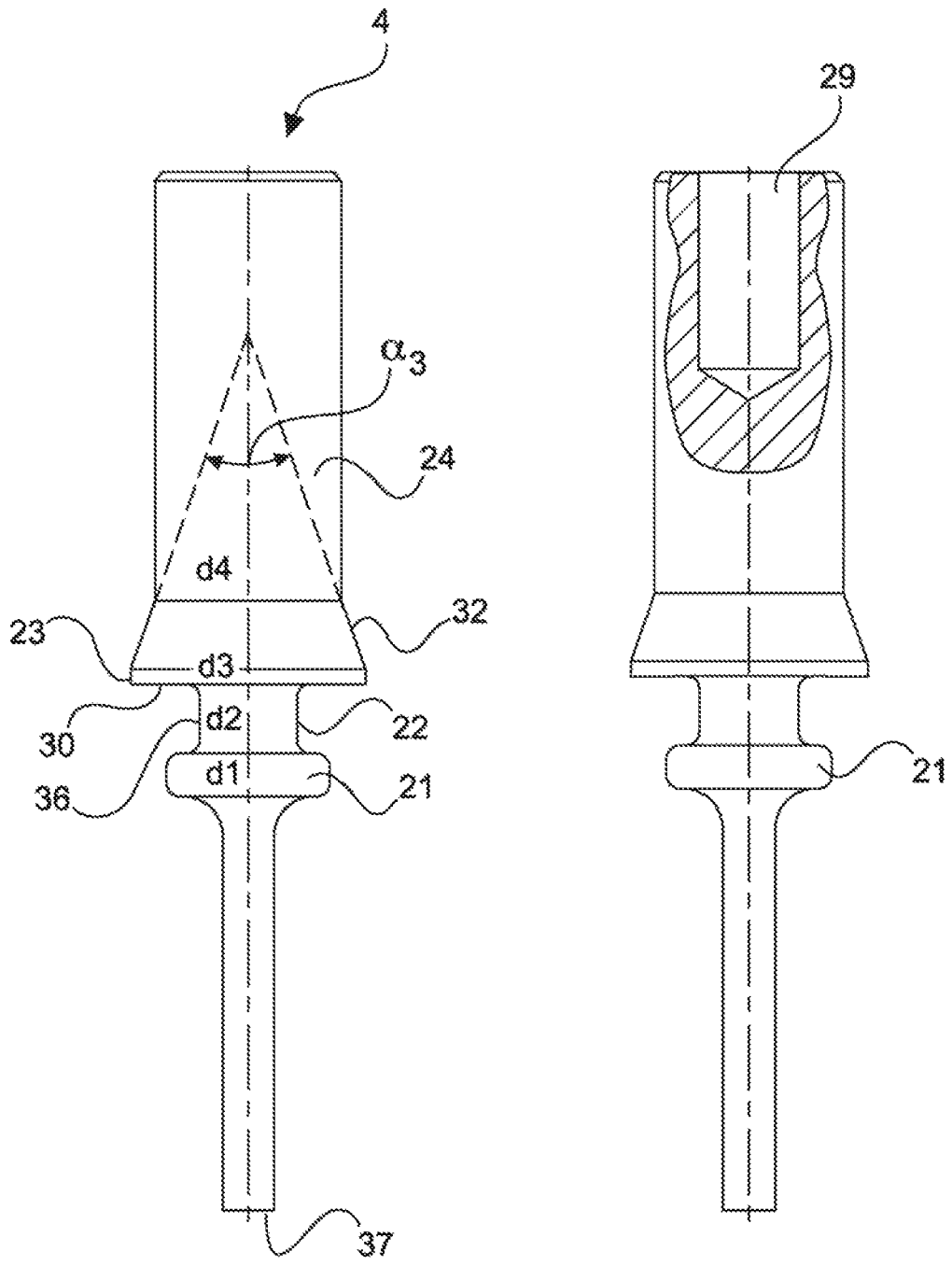
FIG. 4 shows yet another partial view of the sprinkler according to FIG. 1.
Figure 5:
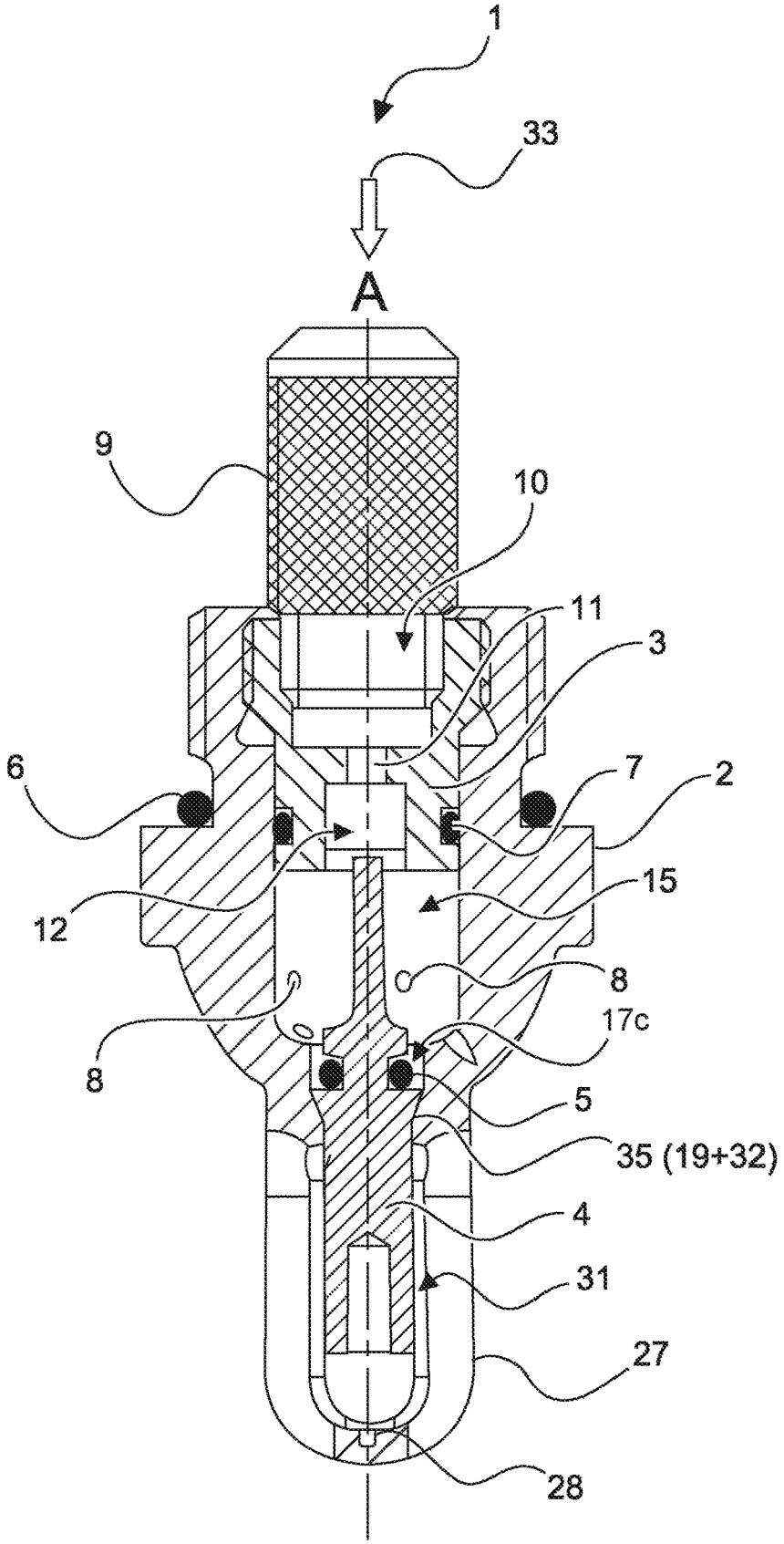
FIG. 5 shows a schematic view of the sprinkler according to FIG. 1 in a second operating state.
Figure 6A:
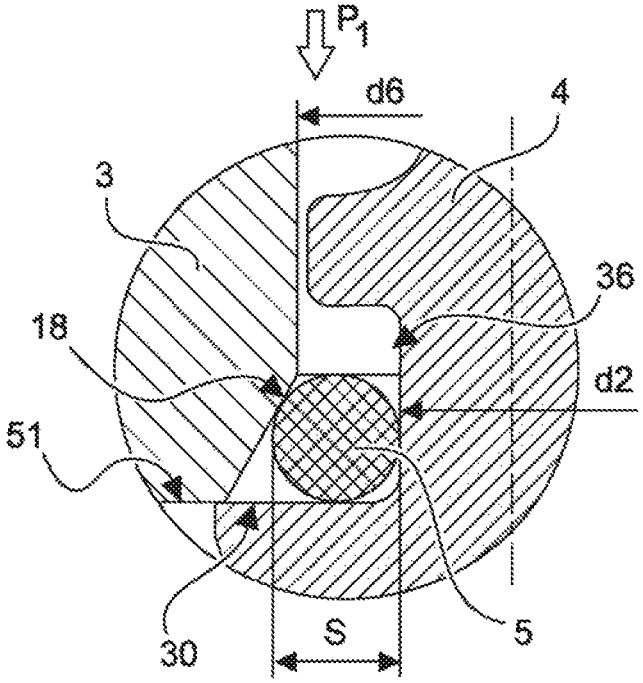
Figure 6B:
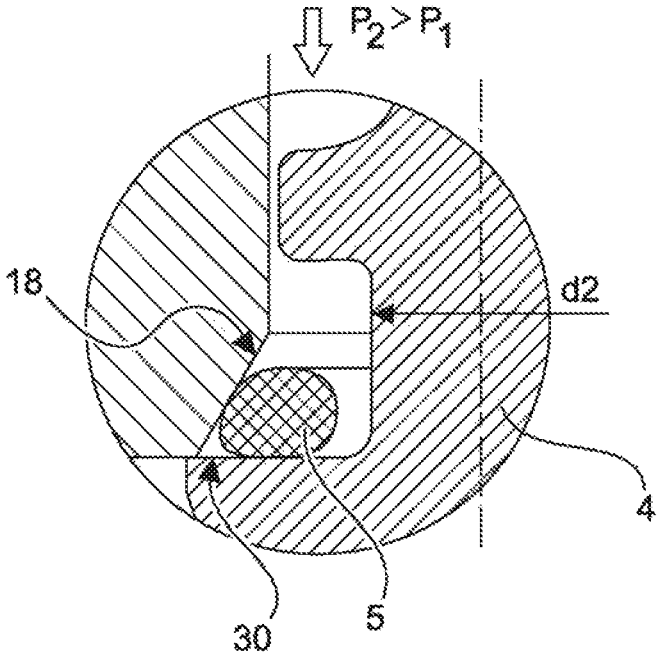

FIGS. 6*a, b* show a partial view of the sprinkler according to the above Figures in the first operating state and in a third operating state; and FIGS. 7*a-f* show various alternative designs of a part of the sprinkler according to FIGS. 1 to 6.

DETAILED DESCRIPTION

Figure 1:
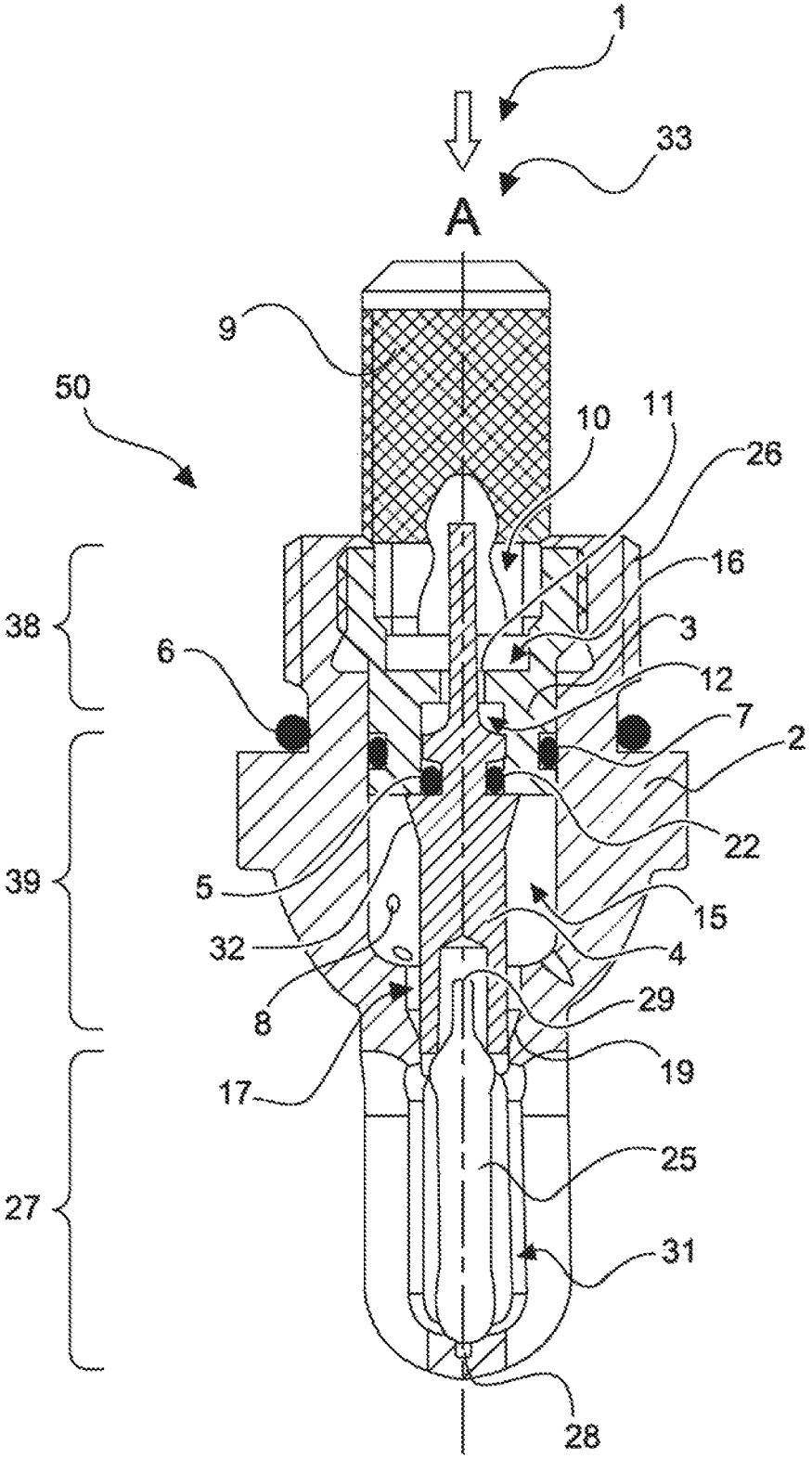
FIG. 1 shows a schematic illustration of a sprinkler in a first operating state.

FIG. 1 shows a sprinkler 1 according to a preferred exemplary embodiment. The sprinkler 1 has a sprinkler housing 50. The sprinkler housing 50 comprises a main body 2, a passage unit 3 and a fluid channel 12, which extends from a fluid inlet 10 to a plurality of fluid outlets 8. A closure element 4 is arranged in a linearly movable manner in the interior of the sprinkler housing 50. In FIG. 1, the closure element 4 is shown in a blocking position in which a sealing element 5 which is compressed radially and axially between the closure element 4 and the passage unit 3 closes the fluid channel 12 and thus prevents the fluid-conducting connection between the fluid inlet 10 and the fluid outlets 8.

A diaphragm 11 for restricting the flow speed is preferably formed in the passage unit 3.

The closure element 4 is kept in the blocking position shown in FIG. 1 by a thermally activatable triggering element 25. The thermally activatable triggering element 25 is held in a cage 27 which is integrally formed on the sprinkler housing 50, in particular on the main body 2. For this purpose, the cage 27 has a first abutment 28 for the axial, and preferably radial, positioning of the thermally activatable triggering element 25, while the closure element 4, at its end facing the thermally activatable triggering element 25, preferably has a second abutment 29 for the axial and/or radial positioning of the thermally activatable triggering element 25. The thermally activatable triggering element 25 sits in a cage compartment 31 defined by the cage 27, and is inserted and held there without a screw connection. The stress required for holding the thermally activatable triggering element 25 is determined exclusively by the dimensioning of the closure element 4 and the compressive force, which acts in the release direction A (FIG. 5), of the extinguishing fluid (reference sign 33) lined up in the fluid channel 12 above the sealing element 5.

A receiving channel 16 for receiving a sieve unit 9 on the side of the fluid inlet 10, and a distribution chamber 15 are formed in the sprinkler housing 50. The fluid outlets 8 and a recess 17 for receiving the closure element 4 branch off from the distribution chamber 15.

The sprinkler housing 50 has a connection unit 38 with a coupling mechanism 26, preferably an external thread, wherein the closure unit 38 serves to connect the sprinkler 1 to a pipe system conducting the extinguishing fluid. For the sealing of the connection unit 38, the sprinkler 1 has a sealing element 6. The passage unit 3 is furthermore sealed in relation to the main body 2 by means of a sealing element 7.

The main body 2 has a nozzle head 39 adjacent to the section of the connection unit 38. The distribution chamber 15 with the fluid outlets 8 is formed in the section of the nozzle head 39. Axially adjacent to the section of the nozzle head 39, the cage 27 is integrally formed on the main body 2, and therefore the main body 2 is formed integrally together with the distribution chamber 15 and cage 27.

Figure 2:
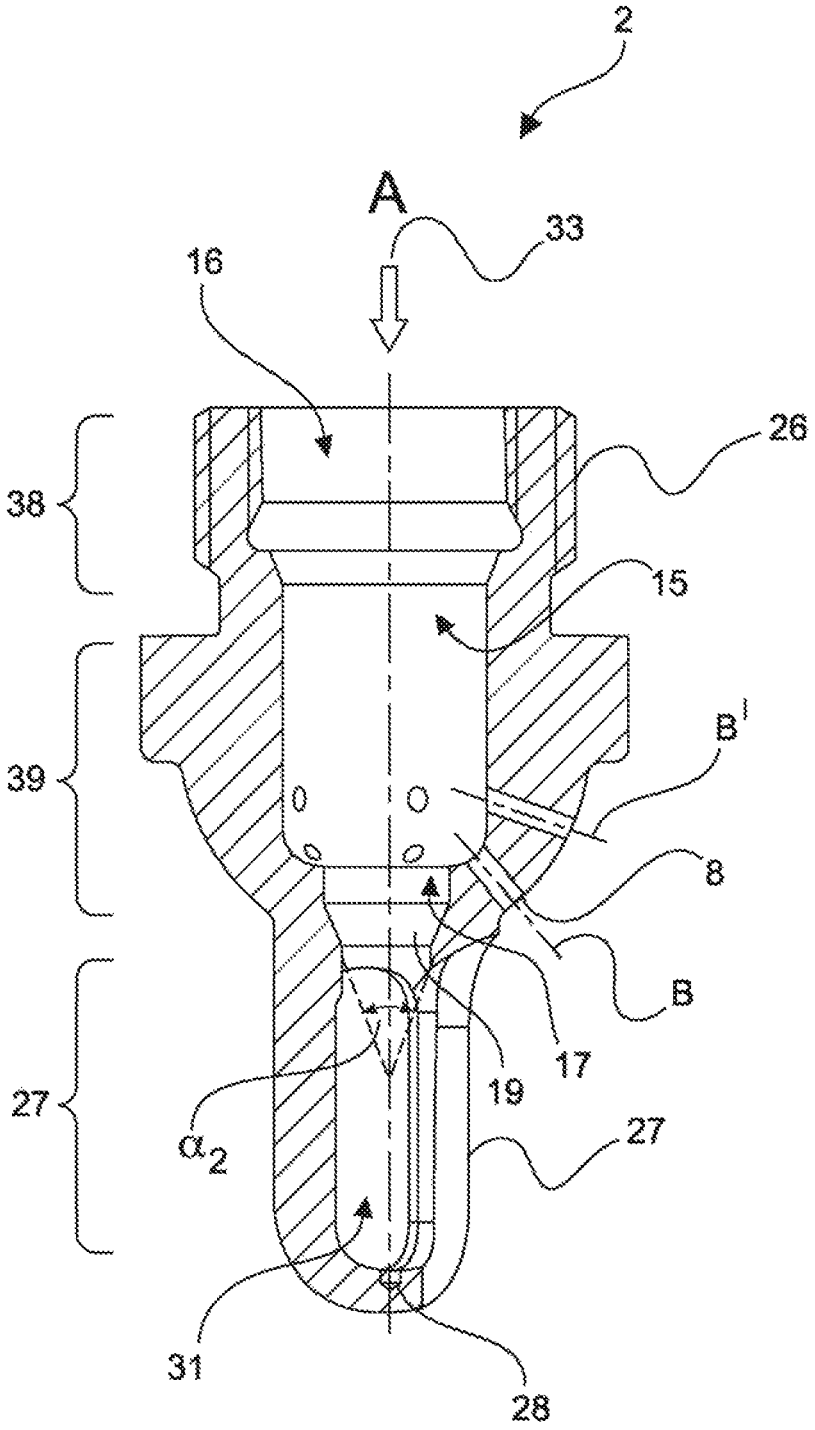
FIG. 2 shows a partial view of the sprinkler according to FIG. 1.

As furthermore clearly arises from FIG. 2 in conjunction with FIG. 4, the fluid outlets 8 extend in one or more second direction(s) B, B', differing from the release direction A, while the recess 17 extends in the release direction A. The extinguishing fluid, indicated by reference sign 33, flowing into the distribution chamber 15 in the release direction A first of all flows in the direction of the recess 17, and has to be diverted from this direction in order to emerge from the fluid outlets. This is discussed in more detail with respect to FIG. 5.

A sealing surface 19 which is tapered in the release direction A is formed at the lower end of the recess 17 in FIG. 2. In the above exemplary embodiment, the tapered sealing surface 19 is of conical design with an angle of taper $\alpha_2$. The closure element 4, illustrated in more detail in FIG. 4, has a sealing surface 32 which, in the mounted state, is likewise tapered in the release direction A and is of conical design in the above exemplary embodiment and has an angle of taper $\alpha_3$. The angles of taper $\alpha_2$ and $\alpha_3$ preferably do not deviate from each other or deviate only slightly, in particular in a region of <5°. The preferably correspondingly designed, tapered sealing surfaces 19, 32 serve as a stop for the closure element in the release position according to FIG. 5. They preferably form an elastomer-free seal 35.

The sealing function of the sealing element 5 will now be explained in more detail with reference in particular to FIGS. 3, 4 and 6*a, b*. A sealing surface 18 which is expanded in the release direction A is formed at the passage unit 3. In the present exemplary embodiment, the expanding sealing surface 18 is of conical design with an angle of taper $\alpha_1$. The diameter of the fluid channel 12 consequently becomes continuously larger in the release direction A over the course of the expanding sealing surface 18. In the blocking position according to FIG. 1, the sealing element 5 lies against the expanding sealing surface 18 and, because of the non-parallel profile of the expanding sealing surface 18 relative to the release direction A, is compressed both radially and axially. This compression behavior is assisted by the fact that, in the blocking position (FIG. 1), the sealing element 5 is pressed against a radially extending sealing surface 30 and an axially extending sealing surface 36. The contact surfaces between the sealing element 5, the passage unit 3 and the closure element 4 therefore form partial sealing surfaces which are each smaller than a single sealing surface would be in the case of a sprinkler known from the prior art with a sealing element.

The compression behavior of the sealing element 5 will now be explained in more detail with respect in particular to FIGS. 6*a, b*. In FIG. 6*a*, a first pressure $P_1$ is present on the inlet side of the sprinkler 1. Said pressure is also referred to as a stand-by pressure, and can lie, for example, within a range of 10-13 bar, preferably <12.5 bar. In this installation situation, the sealing element 5 takes on a material thickness S. If the pressure rises to a value $P_2$, shown in FIG. 6*b*, the sealing element 5 is initially still compressed further and is pressed more greatly in the direction of the expanding sealing surface 18 and the radially extending sealing surface 30. The active area of the operating pressure on the closure element is thereby increased. The advantageous configuration of the sealing arrangement in the stand-by mode according to FIG. 6*a* is in particular shown here. When the triggering pressure, which is equal to or greater than the value $P_2$, is exceeded, for example within the range of 40 bar or more, the closure element 4 is moved along out of the blocking position according to FIG. 1 after the thermally activatable triggering element 25 has escaped. The sealing element 5 immediately, merely after a few fractions of a millimeter, loses contact with the expanding sealing surface 18 and releases the fluid flow.

Figure 3:
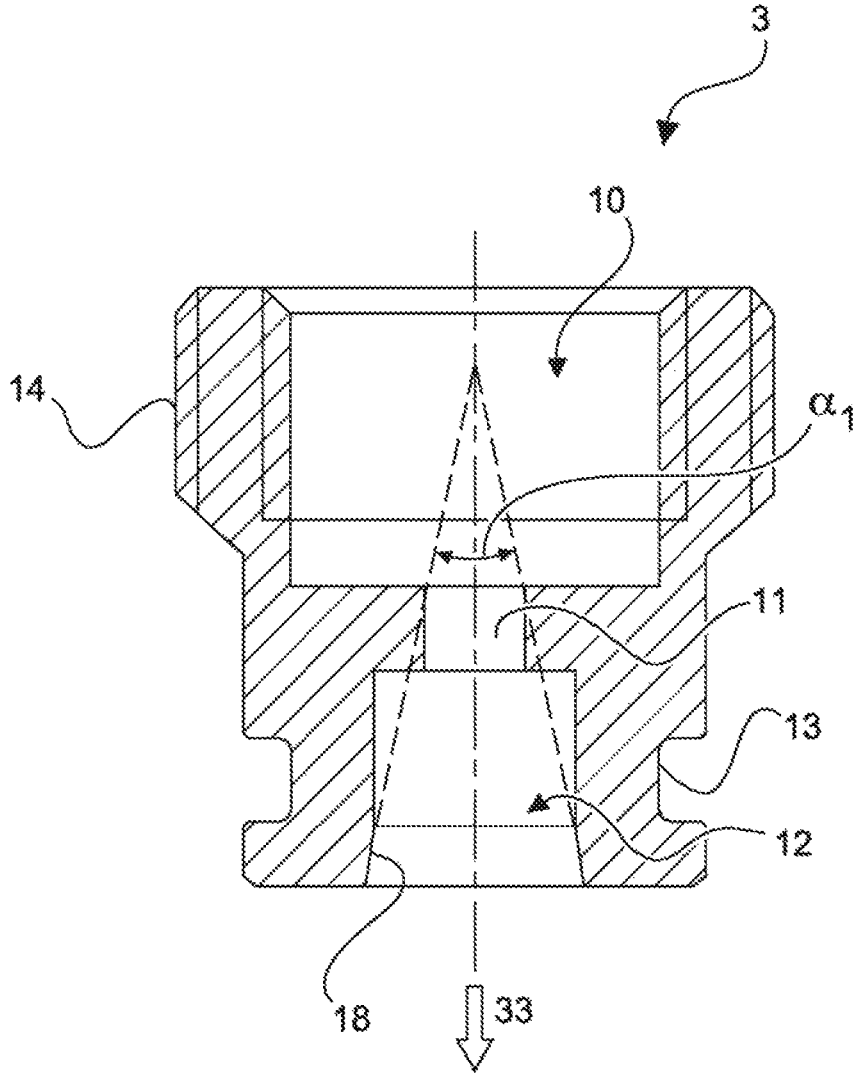
FIG. 3 shows a further partial view of the sprinkler according to FIG. 1.

The passage unit 3 which accommodates the sealing surface 18, which expands in the release direction A, is preferably manufactured as a machined workpiece and, on its outer circumferential surface, has a groove 13 for receiving the sealing element 7 (FIG. 3).

A refinement protecting the sealing element 5 in the release position according to FIG. 5 against wear and destruction will in particular be explained below. For this purpose, reference is made in particular to FIGS. 4 and 5.

In the release position of the sprinkler 1 that is shown in FIG. 5, extinguishing fluid 33 presses into the distribution chamber 15 in the release direction A. The closure element 4 is in the release position, shown at the bottom in FIG. 5. At the distribution chamber 15, a protective chamber 17*c*, in which the sealing element 5 is accommodated, is formed between the closure element 4 and the branching-off recess 17. The protective chamber 17*c* lies on the other side of the main flow direction from the fluid inlet to the fluid outlets 8 because the latter extend in the directions B, B' in a departure from the release direction A (see FIG. 2). By means of this remote arrangement of the sealing element 5, the sealing element 5 is in a region of reduced flow in the release position of the closure element 4 and is less greatly subject to wear due to a rapid flow of the extinguishing fluid. This significantly reduces the susceptibility of the sealing element 5 to being destroyed and reliably prevents blocking of the fluid outlets 8 with sheared-off or torn-off material of the sealing element 5.

The fluid outlets 8 lie radially outside the recesses 17. In the configuration depicted, the closure element 4 has an encircling groove, characterized by the axially extending sealing surface 36 as the groove base. The sealing element 5 is accommodated in said groove. By the sealing element 5 being arranged on the closure element 4 in a manner at least partially retracted into the groove, exposure to the extinguishing fluid flow forced in the direction of the fluid outlets 8 is further reduced. Counter to the release direction A and adjacent to the groove 36, a projection 21 is formed on the closure element and protects the sealing element 5 against flow influences in the release position. A flow diverter 37 which extends counter to the release direction A is particularly preferably formed on the projection 21. In the blocking position shown in FIG. 1, the flow diverter 37 preferably extends for a distance through the diaphragm into the fluid channel 12 in the direction of the fluid inlet 10. In the release position shown in FIG. 5, the flow diverter 37 still extends at least for the most part through the distribution chamber 15 in the direction of the fluid inlet 10. Extinguishing fluid flowing into the distribution chamber 15 is at least retarded by the flow diverter 37, as a result of which the dynamic pressure portion of the extinguishing fluid drops and the loading of the sealing element 5 decreases even further or the sealing element 5 is shielded to an even greater extent. The protected arrangement (shown here) of the sealing element 5 in the protective chamber between recess 17 and closure element 4 makes it possible to use the sprinkler housing 50 as an open extinguishing nozzle without insertion beforehand of a thermally activatable triggering element 25.

Considerable synergy is thereby generated in terms of manufacturing because one and the same component, namely the sprinkler housing 50 together with closure element 4 and sealing element 5, is usable for a plurality of use purposes without having to be refitted. The protected arrangement of the sealing element 5 means that the latter is less likely to be damaged or destroyed, as a result of which inadvertent obstruction of the fluid outlets 8 is even more reliably prevented.

The structure of the closure element will be described in more detail below with reference first of all to FIG. 4.

The closure element 4 is preferably designed as a rotationally symmetrical body having a plurality of sections, in the present example four sections. A first section is the projection 21 with a diameter d1. A second section 22 is present with a diameter d2 and is designed for receiving the sealing element 5. The axial sealing surface 36 and the radial sealing surface 30 are formed in this section. The radial sealing surface 30 is at the same time the transition to a third section 23 with an outer diameter d3 and a section which tapers in the release direction A and has the sealing surface 32. A continuous decrease in diameter in the release direction A to the diameter d4 takes place, wherein a conical profile with the angle of taper $\alpha$3 is formed. From there, a further section extends with a cylindrical profile in the form of a receiving cylinder 24. The receiving cylinder 24 is designed to penetrate the cage compartment 31 of the cage 27 during movement of the closure element from the blocking position (FIG. 1) into the release position (FIG. 5).

The second abutment 29 is preferably formed in this receiving cylinder 24. The diameters d1, d2, d3 and d4 are preferably in the following size relationship:

D1 is greater than d2, d2 is smaller than d3, and d3 is greater than d4. The second region 22 with the diameter d2 is preferably adapted in its length to the material thickness of the sealing element 5. The difference d3−d2 is preferably greater than the material thickness of the sealing element 5 in the unloaded state. The diameter d3 is preferably greater than the outside diameter of the sealing element 5 in the unloaded state. The radially extending sealing surface 30 dimensioned with diameter d3 therefore serves as a stop surface for the closure element and also serves, when the first sealing element 5 is pressed onto the expanding sealing surface 18, to prevent excessive deformation and shearing off of the sealing element 5, or slipping of the sealing element 5 out of the groove during installation.

Owing to a difference in diameter between d2 and d3, the groove, which is characterized by the axially extending sealing surface 36, in the second region 22 should be understood as an asymmetrical groove.

The diameter d2 preferably lies within a range of 1.5 to 50 mm, particularly preferably within a range of 2 to 12 mm, furthermore particularly preferably within the range of 12 mm to 30 mm.

A view will also be given on the structure of the closure element 4 below with reference to FIGS. 7*a* to 7*f*.

The different variants of the closure element 4 are illustrated in FIGS. 7*a* to 7*f*. The basic structure of the closure element 4 is similar in all of these variants. A substantial exception is the formation of the projection 21 and of the flow diverter 37 thereon. While the exemplary embodiment according to FIGS. 7*a, b* does not have a flow diverter 37, but rather a differentiation is made essentially in respect of the design of the receiving cylinder 24 and the axial extension of the region between the sealing region 22 and the receiving cylinder 24, in which, according to FIG. 7*a*, a cylindrical intermediate section 23*b* and a slightly conically opposed section 23*a* are still formed, the projection 21 of the closure element 4 according to FIG. 7*c* has a flow diverter 37 in the form of an encircling annular projection 37*a* on the end side 40. The projection 37*a* can conversely also be defined as a concave recess 41 in the end side 40.

Figure 7A:
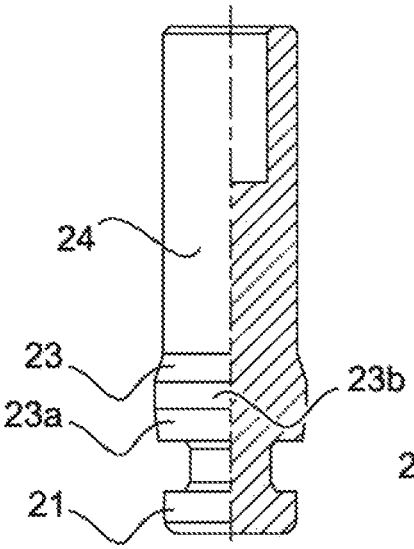
Figure 7B:
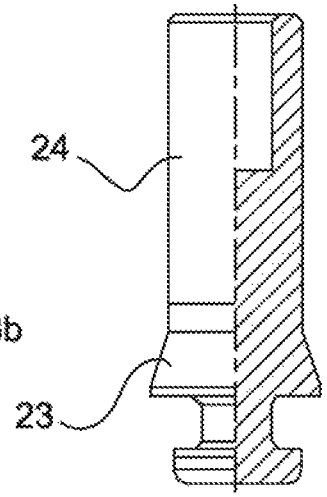
Figure 7C:
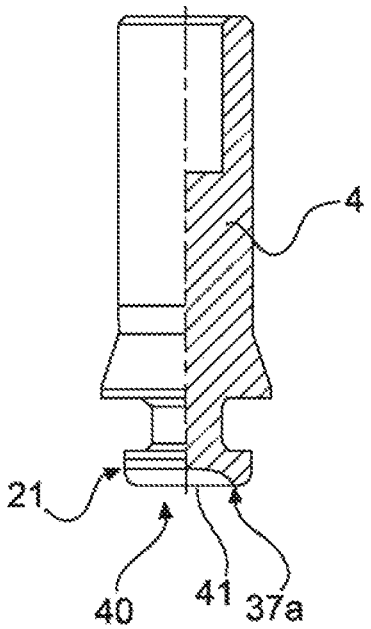
Figure 7D:
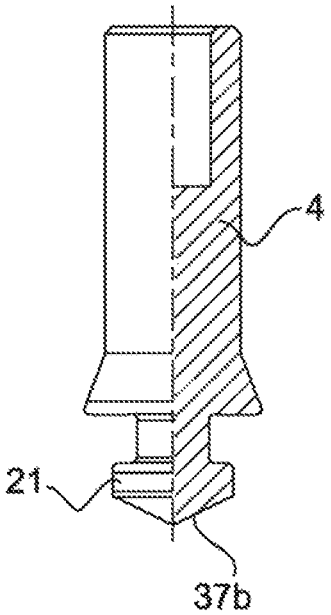

In the case of the closure element 4 according to FIG. 7*d*, a cone point 37*b* is formed on the projection 21, said cone point advantageously assisting the diversion of the extinguishing fluid, which penetrates the distribution chamber 15, radially outward toward the fluid outlets 8.

Figure 7E:
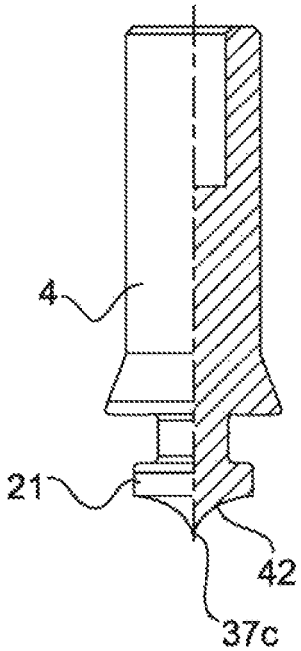
Figure 7F:
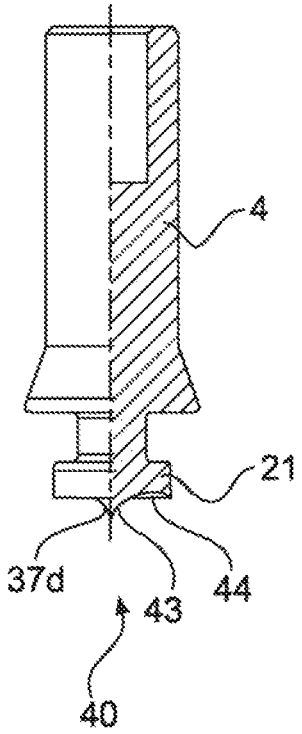

According to FIG. 7*e*, a point 37*c* having a concavely curved lateral surface 42 is formed on the projection 21 of the closure element 4. The concave curvature assists the deflection of the fluid in the direction of the fluid outlets 8 and reduces the impact effect of the fluid striking against the projection 21. FIG. 7*f* shows a variant of the closure element 4, in which a point 37*d* having a concavely curved lateral surface 43 is likewise formed on the projection 21, wherein the concavely curved lateral surface leads into a concave recess 44 on the end side 40, which assists a deflection of the fluid, which strikes against the projection 21, counter to the release direction A.

The advantages of the integral configuration of the main body 2 together with cage 27 and the advantageous effects of preferred combinations of materials will be discussed below.

Owing to the fact that the sprinkler housing 50 has a main body 2 in which both the distribution chamber 15 with the fluid outlets 8, and the cage 27 with the cage compartment 31 are integrally formed, a thermally activatable triggering means 25 can be inserted and then held securely, preferably in the abutments 28, 29, merely by installation of the closure element. An insertion and bracing of the thermally activatable triggering element by means of threaded pins and similar means, as are known from the prior art, can be omitted here. Working steps are saved during the installation, and the risk of premature damage to the thermally activatable triggering element by means of too great a stressing force is prevented.

The integral main body 2 is preferably formed from a seawater-resistant copper alloy, for example seawater-resistant brass or one of the other materials mentioned above. However, the seawater-resistant copper alloy is particularly preferred. Furthermore preferably, the main body is chemically nickel plated at least in the region of the fluid outlets, but preferably completely. During the chemical nickel plating, a nickel-phosphorus coating is placed onto the basic material by autocatalytic deposition. Said coating is preferably further hardened by means of a heat treatment. The residence duration and temperature of the heat treatment is preferably adapted here to the melting point of the basic material. If polymers are used as the basic material, the temperature of the heat treatment is naturally lower than in the case of metals, such as, for example, a brass material. The coating created by chemical nickel plating has the particular advantage that, with the aid thereof, the abrasion resistance of materials which are non-curable when taken into isolation, for example brass, can be significantly increased. By this means, the advantages of various materials are favorably linked to one another by sprinkler systems.

The integral combination with the abovementioned choice of materials and heat treatment has the particular advantage that the sprinkler housing 50 as a whole is significantly less susceptible to clogging. Within the course of the approval test of sprinklers and extinguishing nozzles, it has to be ensured that the fluid outlets change only very slightly, if at all, in respect of their pass-through rates over the course of the operation. This relates firstly to a reduction of the outlet cross section by means of obstructions (therefore clogging) but secondly also to the increase in the outlet cross section by means of abrasion. In particular whenever engineering water or seawater is used as the extinguishing fluid, i.e., in simplified terms, water having a particle loading or other impurities, the risk of an increase in the outlet cross sections is generally greater than an obstruction. By means of the increased hardness in conjunction with the corrosion resistance of the basic material and of the coating, the disclosure provides surprisingly good properties in this regard in an integral main body.

The invention claimed is:

1. A sprinkler, comprising a sprinkler housing, a fluid channel having a sealing surface which is provided in the sprinkler housing and has a fluid inlet and at least one fluid outlet, a closure element, which is movable from a blocking position into a release position, wherein the closure element closes the fluid channel in the blocking position and releases same in the release position, the closure element having a groove, a thermally activatable triggering element, which keeps the closure element in the blocking position until thermally activated, and a sealing element, which is arranged at least partially into the groove and between the sprinkler housing and the closure element and is designed to close the fluid channel in a fluid-tight manner in the blocking position, wherein the sealing element is radially and axially compressed in the blocking position in order to apply the sealing effect, wherein the sealing element is directly pressed in the blocking position against the sealing surface which expands in a release direction, wherein the expanding sealing surface is formed on the sprinkler housing, and wherein the sealing element is located within the sprinkler housing in the blocking position and the release position.

2. The sprinkler as claimed in claim 1, wherein the expanding sealing surface is of at least partially conical design.

3. The sprinkler as claimed in claim 2, wherein the sealing element is selected from the list consisting of: an O ring, quad ring, multi-lip sealing ring, X ring or V ring, or in the form of a combination of a plurality of said sealing elements.

4. The sprinkler as claimed in claim 2, wherein the expanding sealing surface which is of at least partially conical design has a cone angle $\alpha 1$ which lies within an angular range of 5° to 60°.

5. The sprinkler as claimed in claim 1, wherein the expanding sealing surface is at least partially curved convexly.

6. The sprinkler as claimed in claim 1, wherein the expanding sealing surface is at least partially curved concavely.

7. The sprinkler as claimed in claim 1, wherein the closure element has an axially extending sealing surface against which the sealing element is pressed in the blocking position.

8. The sprinkler as claimed in claim 7, wherein the closure element further comprises a radially extending sealing surface against which the sealing element is pressed in the blocking position.

9. The sprinkler as claimed in claim 7, wherein the closure element has a radially extending sealing surface against which the sealing element is pressed in the blocking position.

10. The sprinkler as claimed in claim 1, wherein the sprinkler housing has a main body and a passage unit, wherein the fluid inlet and/or the expanding sealing surface are formed on the passage unit.

11. The sprinkler as claimed in claim 10, wherein the main body has a connection unit for fastening the sprinkler to an extinguishing fluid supply, a receiving channel for receiving a fluid entry channel, a nozzle head, and a cage, wherein a distribution chamber from which the at least one fluid outlet extends is formed in the interior of the nozzle head, and wherein the cage defines a cage compartment for receiving the thermal triggering element.

12. The sprinkler as claimed in claim 1, wherein the closure element has a second sealing surface which is tapered in the release direction, and the sprinkler housing has a third sealing surface which is tapered in the release direction, wherein the second and third sealing surfaces lie against each other in the release position of the closure element.

13. The sprinkler as claimed in claim 12, wherein the expanding sealing surface is of at least partially conical design.

14. The sprinkler as claimed in claim 12, wherein the expanding sealing surface is at least partially curved convexly.

15. The sprinkler as claimed in claim 12, wherein the expanding sealing surface is at least partially curved concavely.

16. The sprinkler of claim 1, wherein the groove comprises an asymmetrical groove.

17. The sprinkler of claim 16, wherein the asymmetrical groove comprises a radial extending sealing surface and an axially extending sealing surface.

18. The sprinkler of claim 17, wherein the closure element comprises a projection adjacent the asymmetrical groove.

* * * * *